US008222504B1

(12) United States Patent
Ball

(10) Patent No.: US 8,222,504 B1
(45) Date of Patent: Jul. 17, 2012

(54) MUSICAL INSTRUMENT STRING HAVING COBALT ALLOY WRAP WIRE

(75) Inventor: Brian Ball, Indio, CA (US)

(73) Assignee: Ernie Ball Inc., San Luis Obispo, CA (US)

( * ) Notice: Subject to any disclaimer, the term of this patent is extended or adjusted under 35 U.S.C. 154(b) by 0 days.

(21) Appl. No.: 13/187,788

(22) Filed: Jul. 21, 2011

Related U.S. Application Data

(63) Continuation of application No. 13/156,057, filed on Jun. 8, 2011, now abandoned.

(60) Provisional application No. 61/477,299, filed on Apr. 20, 2011.

(51) Int. Cl.
*G10D 3/10* (2006.01)

(52) U.S. Cl. ..... 84/297 S

(58) Field of Classification Search ..... 84/297 S
See application file for complete search history.

(56) References Cited

U.S. PATENT DOCUMENTS

| | | | |
|---|---|---|---|
| 3,842,605 | A | 10/1974 | Woodard et al. |
| 6,057,498 | A | 5/2000 | Barney |
| 6,580,021 | B2 | 6/2003 | Barney |
| 7,087,828 | B2 | 8/2006 | Krieger |
| 7,777,108 | B2 | 8/2010 | Vosough et al. |
| 7,893,331 | B2 | 2/2011 | Klanner |
| 2003/0226441 | A1 | 12/2003 | Barney |
| 2009/0272246 | A1 | 11/2009 | Richter |

*Primary Examiner* — Jeffrey Donels
(74) *Attorney, Agent, or Firm* — Denton L. Anderson; Sheldon Mak & Anderson PC

(57) ABSTRACT

The invention is a string for a musical instrument comprising (a) a core wire, and (b) a wrap wire coiled tightly around the core wire, the wrap wire comprising a magnetic cobalt-containing alloy.

18 Claims, 2 Drawing Sheets

MUSICAL INSTRUMENT STRING HAVING COBALT ALLOY WRAP WIRE

RELATED APPLICATIONS

This application is a continuation of U.S. patent application Ser. No. 13/156,057, filed on Jun. 8, 2011 now abandoned, entitled "MUSICAL INSTRUMENT STRING HAVING COBALT ALLOY WRAP WIRE." This application also claims priority from U.S. Provisional Application No. 61/477,299, filed on Apr. 20, 2011, entitled "COBALT ALLOY GUITAR STRINGS."

FIELD OF THE INVENTION

This invention relates generally to musical instrument strings and, more specifically, with metallic musical instrument strings for musical instruments having magnetic pickups.

BACKGROUND OF THE INVENTION

Musical instruments having instrument strings comprising a core wire around which is disposed a wrap wire are very common. Typically, such "wound strings" are used for strings providing the lower notes on the instrument. For example, wound strings are typically used on all strings of a bass guitar, the four bass strings of a steel-string acoustic guitar, the three bass strings of a six-string electric guitar and the four bass strings of a seven-string electric guitar.

Also, it is common for stringed musical instruments to amplify the sound provided by such instruments. A common way of providing amplification is by disposing the strings of the instrument over a pickup. A pickup device acts as a transducer that captures mechanical vibrations from the strings, and converts them to an electrical signal which can be amplified, recorded and/or broadcast.

One of the most common type of pickup is a magnetic pickup. A magnetic pickup consists of a permanent magnet wrapped with a coil of fine enameled copper wire. The vibration of nearby soft magnetic strings modulates the magnetic flux linking the coil, therefore inducing an alternating current through the coil. This signal is then sent on to amplification or recording equipment.

SUMMARY OF THE INVENTION

The invention is a string for a musical instrument comprising (a) a core wire, and (b) a wrap wire coiled tightly around the core wire, the wrap wire comprising a magnetic cobalt-containing alloy.

DRAWINGS

These and other features, aspects and advantages of the present invention will become better understood with reference to the following description, appended claims and accompanying drawings where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
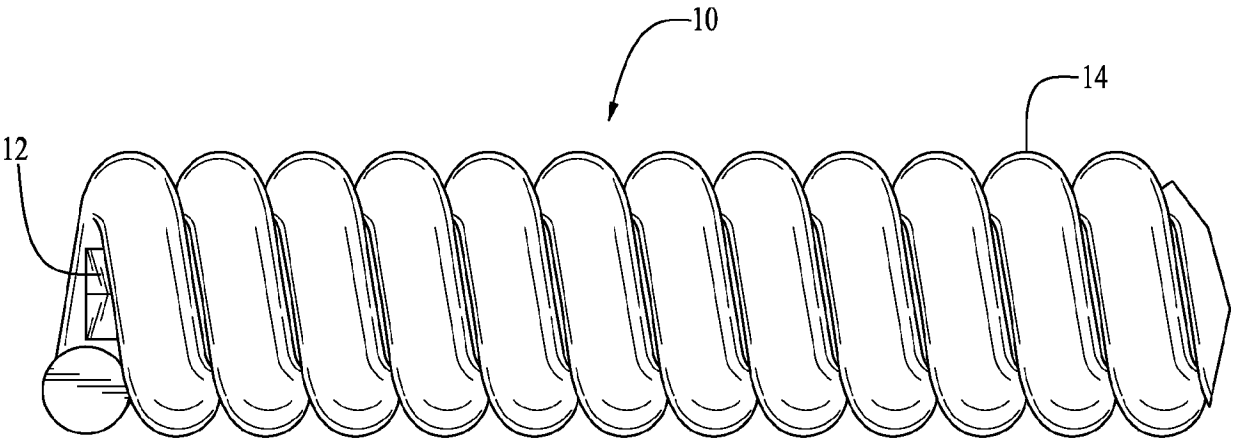
FIG. 1 is a side view of a musical instrument string having features of the invention.
Figure 2:
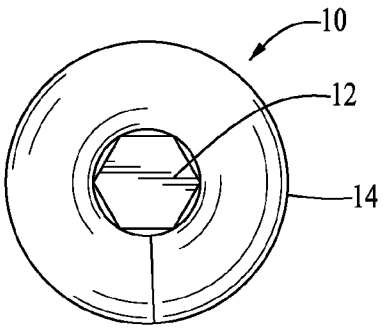
FIG. 2 is a cross-sectional view of the musical instrument string of FIG. 1, taken along line 2-2.

In one aspect of the invention, the invention is a musical string 10 for a musical string instrument comprising (a) a core wire 12, and (b) wrap wire 14 coiled tightly around the core wire. In the invention, the wrap wire 14 comprises a magnetic cobalt-containing alloy. One embodiment of this aspect of the invention is illustrated in FIGS. 1 and 2.

Typically, the core wire 12 is steel, although other magnetic alloys can be used as well. Also, the core wire 12 can be optionally plated with tin or other metal. The tensile strength of the core wire 12 is, preferably, at least about 150 ksi. The core wire 12 is most usually spring tempered. As can be seen in FIG. 2, the core wire 12 can have a hexagonal cross-section, but other cross-sections can also be used.

With respect to the wrap wire 14, the cobalt-containing alloy, unlike many other cobalt-containing alloys, is a soft magnetic alloy. By "magnetic," it is meant that the alloy is easily magnetized and demagnetized and/or has a high magnetic permeability with a high magnetic saturation level. Having a high magnetic permeability and a high magnetic saturation level allows the string to be highly responsive to strong magnetic fields and to thereby have increased output and wider dynamic range when used in an instrument having a magnetic pickup.

The wrap wire 14 can have a cobalt content of between about 2 wt. % and about 98 wt. % of the alloy.

One example of the cobalt-containing alloy of the wrap wire 14 is an iron-cobalt alloy, wherein iron constitutes the major co-constituent (with cobalt) of the alloy. In an iron-cobalt alloy useable in the invention, iron typically comprises most of the non-cobalt content. However, other metals can also be incorporated into the alloy, including chromium (typically in amounts between about 0.25 wt. % and 7 wt. %), vanadium (typically in amounts between about 1 wt. % and about 5 wt. %), manganese (typically between about 0.25 wt. % and about 1 wt. %) and nickel (typically between about 0.25 wt. % and about 7 wt. %).

The inventor has found that the percentage of cobalt in an iron-cobalt alloy can surprisingly be relatively small and still provide superior response. Preferably, the weight percent of cobalt in the alloy is between about 5 wt. % and about 60 wt. %, most preferably between about 8 wt. % and about 35 wt. %. Examples of alloys suitable in the invention are AFK 502, AFK 18 and AFK 1 marketed by Arcelor Mittal Stainless & Nickel Alloys S.A. of Saint Denis, France. Such alloys retain high magnetic saturation characteristics and have relatively high ductility.

Another example of the cobalt-containing alloy of the wrap wire 14 is a nickel-cobalt alloy, wherein nickel constitutes the major co-constituent (with cobalt) of the alloy. In a typical nickel-cobalt alloy, the percentage of cobalt in the alloy is less than about 75%. In a nickel-cobalt alloy, nickel typically comprises most of the non-cobalt material. However, other metals can be incorporated into the alloy, including chromium, vanadium, iron and manganese. Nickel-cobalt alloys useful in the invention include certain commercially available magnetic nickel-cobalt alloys having about 17% cobalt, about 29% nickel and about 54% iron.

It is most important that the cobalt-containing alloy be sufficiently ductile to form into wire. Sufficient ductility is critical to the application in order to manufacture the wire, to reduce wire costs and processing, and to form the wire into a suitable string. Some cobalt-containing alloys are not ductile enough to form into wire, and may require alloying additions.

A balanced composition of cobalt and iron or nickel often requires small alloying additions such as vanadium in order to achieve a sufficient level of ductility to be drawn into wire. By utilizing a more ductile alloy, wire manufacturing is more efficient because fewer reductions and anneals are required while the wire is being drawn to the appropriate diameter. This reduces processing time and processing energy—thereby reducing the cost of manufacturing the wire. The wire alloy must also exhibit sufficient ductility in order to ensure that the wire doesn't break while being wrapped around a core wire 12 when making a wound string.

Typically, the wrap wire 14 is fully annealed.

It is preferred that the wrap wire 14 have as smooth a surface finish as practical. Surface smoothness is important in transmitting vibrational energy efficiently. Transmitting vibrational energy efficiently results in a longer sustain and a fuller harmonic response.

Still further, it is preferred that the wrap wire 14 have a fine grain structure. Most preferably, the average grain size of the grains within the alloy microstructure is less than about 20 micrometers.

Finally, it is preferred that the wrap wire 14 have corrosion resistance to salt water, weak acids and weak bases.

Figure 3:
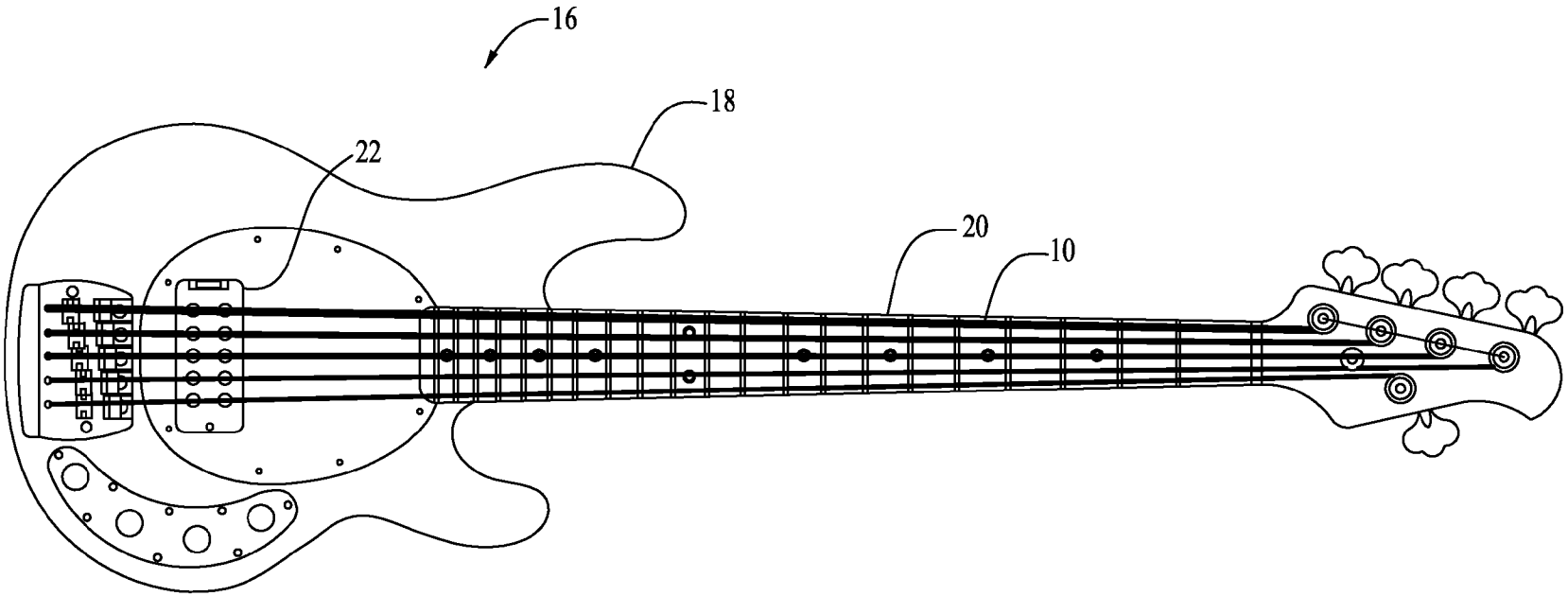
FIG. 3 is a side view of a musical instrument having features of the invention.

In another aspect of the invention, the invention is a musical instrument 16 comprising a body 18, a neck 20, a magnetic pickup 22 and a plurality of instrument strings. The plurality of instrument strings are disposed along the front of the body, along the neck and over the magnetic pickup. In this aspect of the invention, the plurality of strings includes at least one wound string 10 of the invention, as described above. One embodiment of this aspect of the invention is illustrated in FIG. 3.

The invention has been found to provide a musical instrument string with marked increased signal output and magnetic response characteristics over musical instrument strings of the prior art.

Having thus described the invention, it should be apparent that numerous structural modifications and adaptations can be resorted to without departing from the scope and fair meaning of the instant invention as set forth hereinabove and as described hereinbelow by the claims.

What is claimed is:

1. A string for a musical stringed instrument comprising:

(a) a core wire; and (b) a wrap wire coiled tightly around the core wire, the wrap wire comprising a magnetic cobalt-containing alloy.

2. The string for the musical instrument of claim 1 wherein the wrap wire comprises a magnetic iron-cobalt alloy.

3. The string for a musical instrument of claim 2 wherein the weight percent of cobalt in the iron-cobalt alloy is between about 2 wt. % and about 98 wt. %, with iron constituting at least 90 wt. % of the remainder of the alloy.

4. The string for a musical instrument of claim 2 wherein the weight percent of cobalt in the iron-cobalt alloy is between about 5 wt. % and about 60 wt. %, with iron constituting at least 90 wt. % of the remainder of the alloy.

5. The string for a musical instrument of claim 2 wherein the weight percent of cobalt in the iron-cobalt alloy is between about 8 wt. % and about 35 wt. %, with iron constituting at least 90 wt. % of the remainder of the alloy.

6. The string for a musical instrument of claim 2 wherein the alloy further comprises one or more of the following metals: chromium, vanadium, manganese and nickel.

7. The string for the musical instrument of claim 1 wherein the wrap wire comprises a magnetic nickel-cobalt alloy.

8. The string for the musical instrument of claim 7 wherein the nickel-cobalt alloy comprises less than about 75 wt. % of cobalt.

9. The musical instrument of claim 7 wherein the nickel-cobalt alloy further comprises one or more of the following metals: chromium, vanadium, iron and manganese.

10. A musical stringed instrument comprising:

(a) a body;

(b) a neck appended to and extending away from the body;

(c) a magnetic pickup; and (d) a plurality of strings taughtly disposed along the front of the body, along the neck and over the magnetic pickup, the plurality of strings including at least one string of claim 1.

11. The musical instrument of claim 10 wherein the magnetic cobalt-containing alloy is a magnetic iron-cobalt alloy.

12. The musical instrument of claim 11 wherein the weight percent of cobalt in the iron-cobalt alloy is between about 2 wt. % and about 98 wt. %, with iron constituting at least 80 wt. % of the remainder of the alloy.

13. The musical instrument of claim 11 wherein the weight percent of cobalt in the iron-cobalt alloy is between about 5 wt. % and about 60 wt. %, with iron constituting at least 80 wt. % of the remainder of the alloy.

14. The musical instrument of claim 11 wherein the weight percent of cobalt in the iron-cobalt alloy is between about 8 wt. % and about 35 wt. %, with iron constituting at least 80 wt. % of the remainder of the alloy.

15. The musical instrument of claim 11 wherein the alloy further comprises one or more of the following metals: chromium, vanadium, manganese and nickel.

16. The musical instrument of claim 10 wherein the magnetic cobalt-containing alloy is a magnetic cobalt-nickel alloy.

17. The musical instrument of claim 16 wherein the nickel-cobalt alloy comprises less than about 75 wt. % cobalt.

18. The musical instrument of claim 16 wherein the nickel-cobalt alloy further comprises one or more of the following metals: chromium, vanadium, iron and manganese.

* * * * *